United States Patent [19]

Levine et al.

[11] 4,114,211

[45] Sep. 19, 1978

[54] CORNER STIFFENER

[75] Inventors: Alexander M. Levine, Boston; Henry R. Ramsey; Robert T. Martin, both of Dudley, all of Mass.

[73] Assignee: Webster Spring Co. Inc., Oxford, Mass.

[21] Appl. No.: 794,355

[22] Filed: May 6, 1977

[51] Int. Cl.[2] ..... A47C 23/053

[52] U.S. Cl. ..... 5/261; 5/260; 5/351

[58] Field of Search ..... 5/260, 261, 351

[56] References Cited

U.S. PATENT DOCUMENTS

| | | | |
|---|---|---|---|
| Re. 25,742 | 3/1965 | Martin | 5/351 |
| 1,072,490 | 9/1913 | Oilar | 5/319 |
| 2,709,819 | 6/1955 | Wise | 5/351 |
| 2,993,215 | 7/1961 | Rymland | 5/260 |
| 3,206,759 | 9/1965 | Kline | 5/261 |
| 3,327,331 | 6/1967 | Simon | 5/261 |
| 3,737,927 | 6/1973 | Kline et al. | 5/260 |

*Primary Examiner*—Mervin Stein
*Assistant Examiner*—Alex Grosz
*Attorney, Agent, or Firm*—Dike, Bronstein, Roberts, Cushman & Pfund

[57] ABSTRACT

A reinforcing structure for the corners of innerspring assemblies comprising spaced parallel parts disposed diagonally across the top and bottom sides of the innerspring assembly, spring members at the opposite ends of the spaced parallel parts disposed between the top and bottom sides which yieldably resist displacement of the top and bottom sides relative to each other and clips fixing the structures to the top and bottom sides of the assembly. The spring members are torsion springs comprising a coil and angularly disposed arms and these are disposed with the arms situated in the planes of the sides and ends of the assembly. Optionally, the top and bottom parts are longitudinallly adjusted to vary the distance between the spring members.

3 Claims, 7 Drawing Figures

CORNER STIFFENER

BACKGROUND OF THE INVENTION

An innerspring assembly such as used for the manufacture of innerspring mattresses comprises spaced, parallel, substantially rectangular border wires of relatively stiff wire between which are assembled rows of coils with the top and bottom ends situated in the planes of the border wires. Spiral springs are employed to connect the top and bottom ends of the coils to the border wires and to each other. Thus, the border wires are unsupported relative to each other, except by the intervening coils. Consequently, if pressure is brought to bear near the edges or corners, the top of the structure will yield downwardly relative to the bottom and this is especially pronounced at the corners. Because of the closer spacing of coils along the sides, and ends, there is less yield at the sides and ends. Reinforcing spring members have been placed between the border wires along the sides and ends to prevent excessive yield and sometimes to enable providing the desired resistance to yield with lighter gauge wire. It is the purpose of this invention to provide supplemental spring means at the corners which has not been done heretofore to overcome the softness at the corners and further to provide means for this purpose which may be built into the assembly at the time of manufacture of the assembly, or may be supplied to a spring manufacture as a unit which he may then assemble to an already manufactured spring assembly either to improve its resistance to yield or to enable using a lighter gauge wire for the interior of the assembly without collapse at the corners.

SUMMARY OF INVENTION

As herein illustrated, the corner reinforcing members each comprise spaced parallel parts disposed diagonally across the top and bottom sides of the innerspring assembly, spring means at the opposite ends of the spaced parallel parts disposed between the top and bottom parts which yieldably resist displacement of the top and bottom sides relative to each other and clips fixing the members to the top and bottom sides of the assembly. The spring means are torsion springs comprising a coil and angularly disposed arms, and these are disposed with the arms situated in the planes of the sides and ends. The spring assembly comprises spaced parallel border wires of rectangular configuration between which are assembled rows of coils with the upper and lower ends in the planes of the border wires and the corner reinforcing members are disposed diagonally of the corners and comprise spaced parallel parts which are situated in the planes of the border wires. At the ends of these parts, there are parts bent at angles to lie in planes parallel to the ends and sides of the border wires and the arms of the torsion springs are connected to the ends of the bent portions so as to lie in converging planes parallel to the sides and ends of the assembly.

The invention will now be described in greater detail with reference to the accompanying drawings, wherein.

Figure 1:
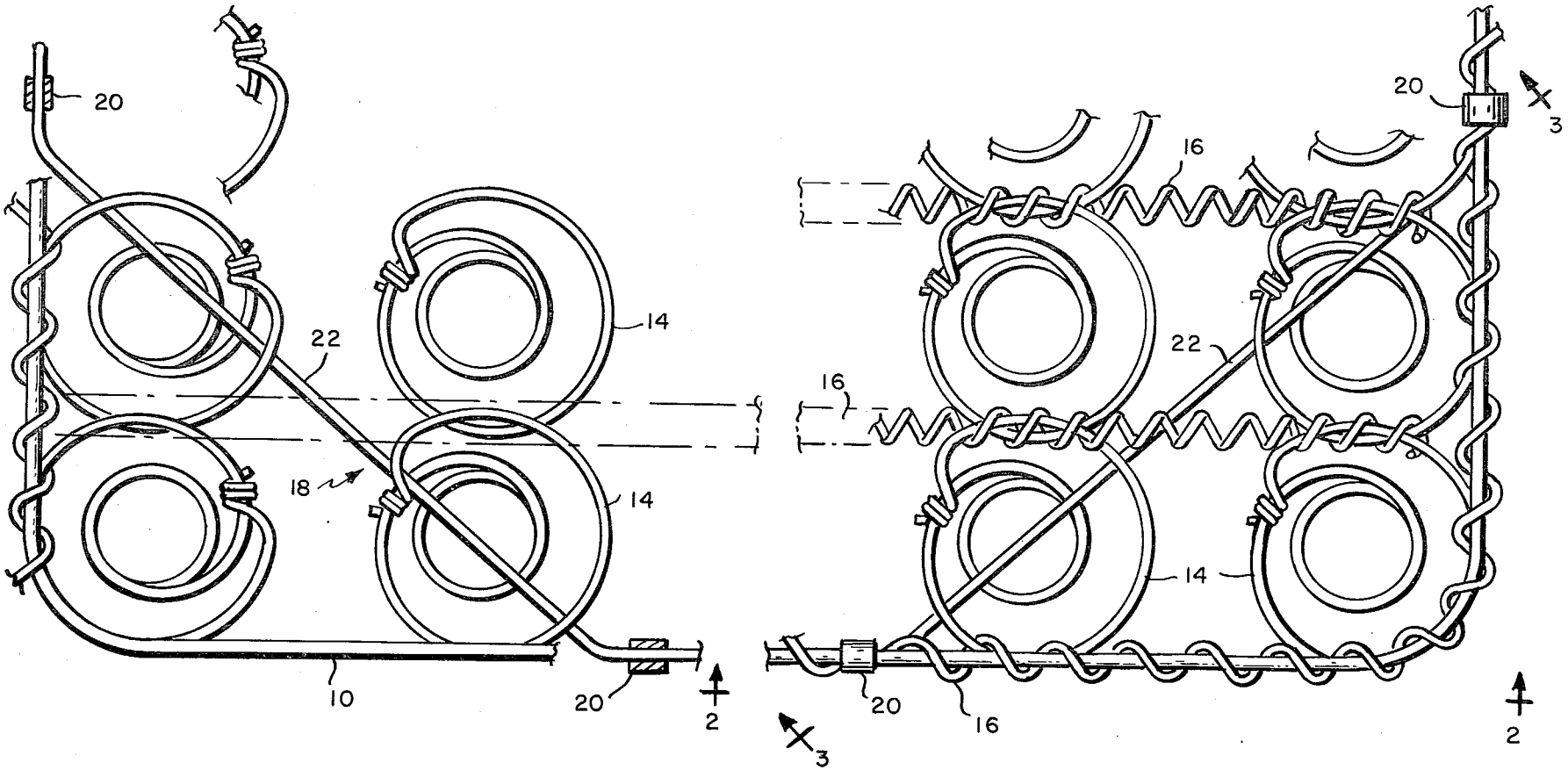
FIG. 1 is a plane view of one end of an innerspring assembly broken away in part showing the corner reinforcing structures applied thereto.
Figure 2:
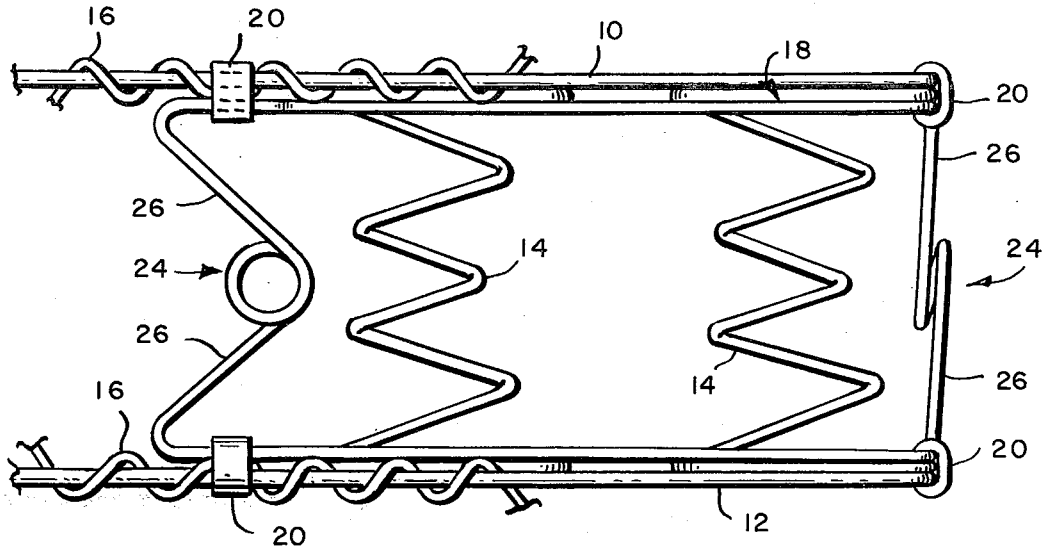
FIG. 2 is an elevation taken on the line 2—2 of FIG. 1.
Figure 3:
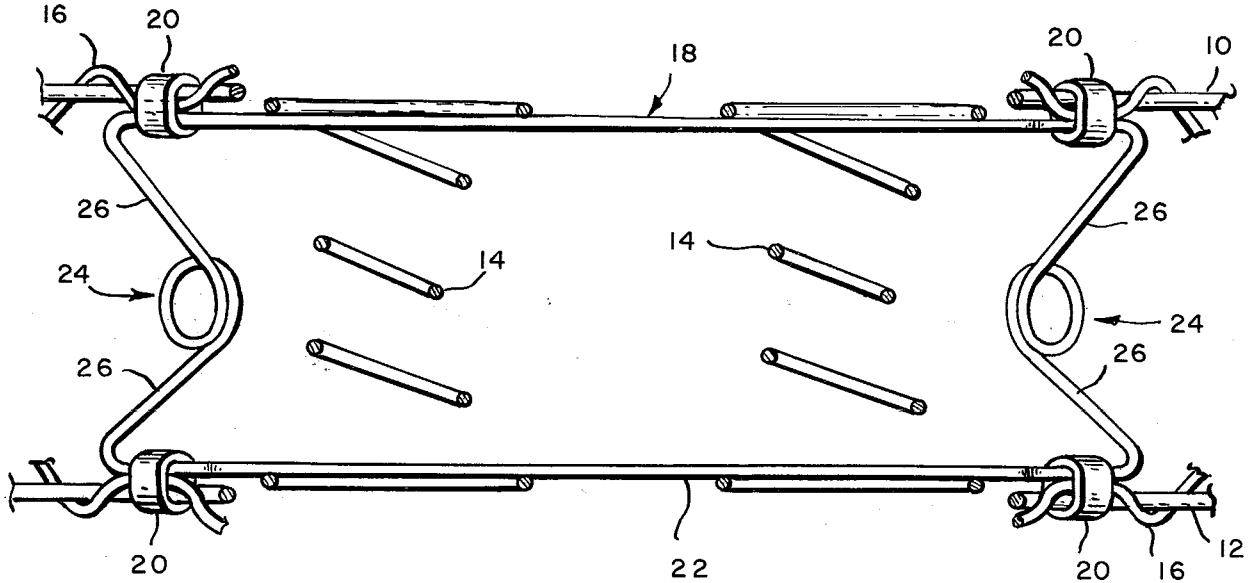
FIG. 3 is an elevation taken on the line 3—3 of FIG. 1.
Figure 4:
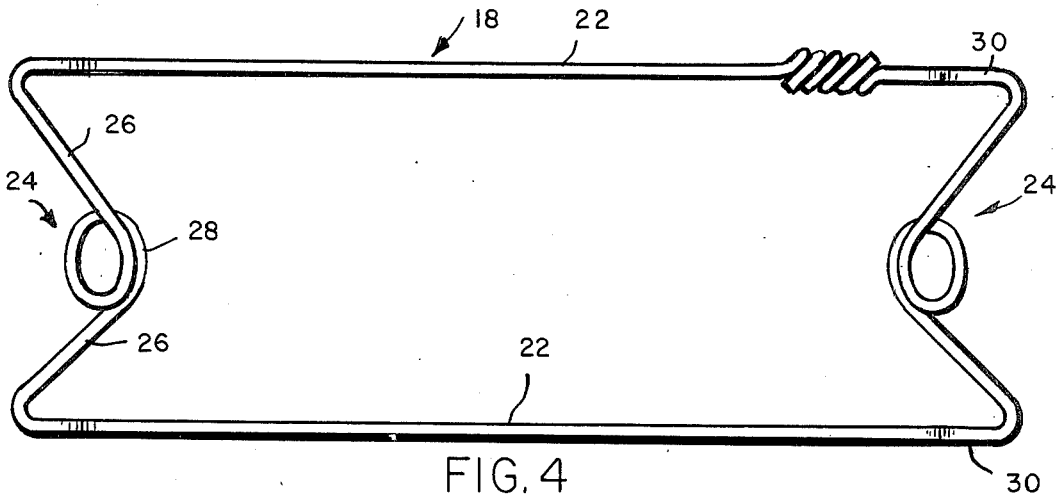
FIG. 4 is an elevation of one form of a corner reinforcing structure removed from the innerspring assembly.

Referring to the drawings, FIGS. 1 to 3, there is shown a conventional innerspring mattress assembly comprising spaced parallel border wires 10 and 12 of rectangular configuration between which are mounted rows of coil springs. The coil springs are connected to the border wires and to each other by spiral springs 16 and, as thus constructed, the border wires are supported in spaced parallel relation solely by the intervening coil springs. Consequently, pressure applied along the sides and ends and to the corners tends to depress the upper side of the innerspring assembly relative to the lower side and this is particularly noticeable at the corners. The purpose of this invention is to reinforce the corners to lessen the depression and this is achieved by means of corner supporting structures 18 such as shown in FIGS. 4 to 7 inclusive. The corner supporting structures 18 are disposed diagonally across the corners of the innerspring assembly as shown in FIGS. 1 to 3 and secure thereto by clips 20 which may be in the form of hog rings. Each corner supporting structure 18, as shown in FIG. 4, comprises spaced parallel parts 22—22, the distance between which corresponds substantially to the distance between the top and bottom border wires joined at their opposite ends by torsion spring means 24—24 which yieldably resist displacement of the parallel parts 22—22 relative to each other. The spring means 24—24 have angularly disposed arms 26—26 connected by coils 28 of one or more loops and the distal ends of the arms 26—26 are connected to the ends of the parallel parts 22—22 so as to lie in converging planes at angles which are substantially 45° to the plane of the parallel parts 22—22. This is achieved by providing bent portions 30—30, FIG. 6, at the ends of the parallel parts 22—22 to which the ends of the arms 26—26 are connected. When fastened to the innerspring assembly, the coils 24 and arms at the opposite ends of the supporting structure lie in the plane of the ends and sides of the innerspring assembly.

Each supporting structure, as shown in FIG. 4, is comprised of a single length of wire and may be applied to the corner of the spring assembly by inserting it through the side or end inwardly of the coil at the corner structure so that the part 22 at the top side is situated just beneath the upper loop of the coils at the corner and part 22 at the lower side above the lowermost loops of the coils, FIG. 1. As thus arranged, the parts 22—22 are parallel to the planes of the top and bottom border wires and substantially in the planes thereof.

Figure 5:
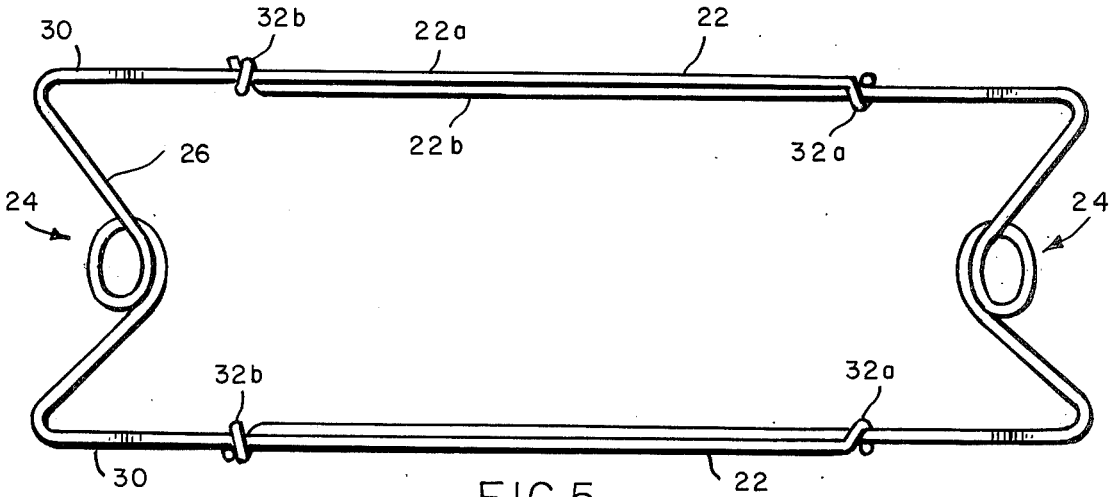
FIG. 5 is an elevation of another form of corner reinforcing structure shown as longitudinally adjustable.
Figure 6:
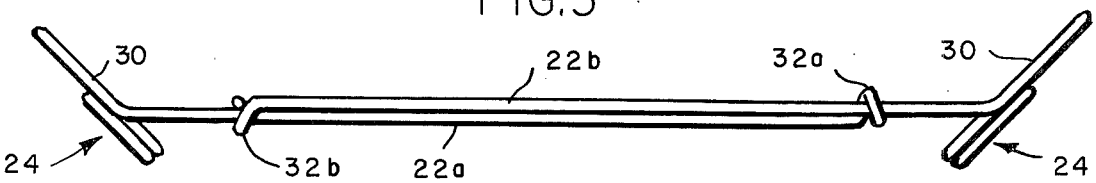
FIG. 6 is a top view of the reinforcing structure shown in FIG. 5.
Figure 7:
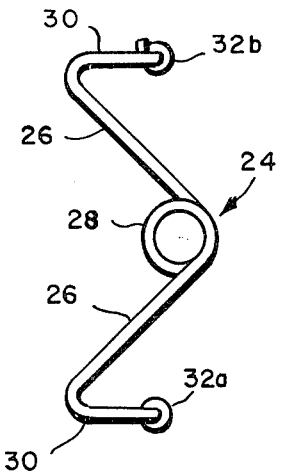
FIG. 7 is an end view of the reinforcing structure shown in FIG. 6.

Since spring assemblies for innerspring mattresses are manufactured in different sizes, it is desirable to make the corner supporting structure adjustable and, accordingly, as shown in FIGS. 5 and 6, the parallel parts 22—22 are made longer than those shown in FIG. 4 so as to have overlapping parallel portions **22*a* —22*b* and the ends of these overlapping portions are provided with twists 32*a* —*b* which encircle and thus slidably connecte the overlapping portions. It is thus possible to adjust the distance between the spring means 24—24** for different size mattress innerspring assemblies and/or to move the spring means closer or farther apart for a given spring assembly to bring the support closer to the corner.

The corner reinforcing structure thus described can, of course, be built into the innerspring assembly when the latter is manufactured. However, it may be manufactured independently of the spring assembly and supplied to spring assembly manufacturers to be secured to innerspring assemblies after they have been manufactured to provide, where desired or where specified, greater stiffness at the corners.

It should be understood that the present disclosure is for the purpose of illustration only and includes all modifications or improvements which fall within the scope of the appended claims.

We claim:

1. A corner stiffener element for an innerspring mattress assembly, wherein coil springs are arranged in a rectangular pattern in longitudinal and transverse rows so that their end coils collectively define spaced, parallel supporting surfaces and wherein there is a border wire frame having horizontal edge and end portions extending along the outer edges of the end coils of the coil springs; one at each of the corners of the assembly in longitudinal and transverse spaced relation so that each is effective independently of every other within the locale of the corner within which it is associated, each element comprising spaced, parallel wires resistant to extension, the distance between which is substantially the distance between the border wires of the assembly, attaching portions at each end of the wires bent at an angle thereto such that an extension of the bent ends would intersect at right angles and compression-resistant means situated between the bent ends and connecting said bent ends which resist displacement of the parallel wires toward each other, comprising coil spring means situated between the bent ends in the planes of the bent ends.

2. A corner stiffener element according to claim 1 wherein said parallel parts each comprise two parallel lengths of wire arranged in overlapping relation and means slidingly connecting the parallel lengths of wires to each other to enable adjusting the lengths of the parallel parts and, hence, the distance between the spring means.

3. The combination with an innerspring assembly wherein coil springs are arranged in a rectangular pattern in longitudinal and transverse rows so that the end coils collectively define spaced, parallel supporting surfaces and wherein there is a border wire frame having horizontal edge and end portions extending along the outer edges of the end coils of the coil springs; of corner reinforcing structures at each corner in longitudinally and transversely spaced relation so that each is effective independently of every other within the locale of the corner with which it is associated, each element comprising spaced, parallel wires resistant to extension, the distance between which is substantially the distance between the border wires of the assembly, disposed diagonally across the corners at the top and bottom sides, attaching portions at each end of the wires bent at an angle such as to be situated in planes parallel to the border wires at the sides and ends of the assembly and compression-resistant means situated between the bent ends and connecting said bent ends which resist displacement of the parallel wires toward each other, comprising coil spring means situated midway between the bent ends in the plane of the bent ends and fastening means fixing the attaching portions to the border wires.

* * * * *